US007690351B2

(12) United States Patent
Kondo

(10) Patent No.: US 7,690,351 B2
(45) **Date of Patent: *Apr. 6, 2010**

(54) THROTTLE VALVE CONTROL DEVICE

(75) Inventor: Yasushi Kondo, Kawasaki (JP)

(73) Assignee: Keihin Corporation, Tokyo (JP)

( * ) Notice: Subject to any disclaimer, the term of this patent is extended or adjusted under 35 U.S.C. 154(b) by 744 days.

This patent is subject to a terminal disclaimer.

(21) Appl. No.: 11/529,339

(22) Filed: Sep. 29, 2006

(65) Prior Publication Data

US 2007/0068581 A1 Mar. 29, 2007

(30) Foreign Application Priority Data

Sep. 29, 2005 (JP) ..... 2005-283425

(51) Int. Cl.
*F02D 11/04* (2006.01)

(52) U.S. Cl. ..... 123/400; 123/337; 123/376; 251/78; 251/248

(58) Field of Classification Search ..... 123/376, 123/399, 400, 377; 137/554; 251/248
See application file for complete search history.

(56) References Cited

U.S. PATENT DOCUMENTS 4,494,639 A * 1/1985 Takano et al. ..... 477/87
5,429,090 A * 7/1995 Kotchi et al. ..... 123/396
5,524,589 A 6/1996 Kikkawa et al.
5,546,903 A * 8/1996 Satou et al. ..... 123/399
6,032,647 A * 3/2000 Sato et al. ..... 123/399
6,039,027 A * 3/2000 Sato et al. ..... 123/399
7,261,083 B2 * 8/2007 Kondo ..... 123/399
2001/0045202 A1 * 11/2001 Shimura et al. ..... 123/399

FOREIGN PATENT DOCUMENTS

JP 07-139376 5/1995
JP 2005-098178 4/2005

* cited by examiner

*Primary Examiner*—Stephen Hepperle
*Assistant Examiner*—Christopher Pilling
(74) *Attorney, Agent, or Firm*—Bacon & Thomas, PLLC

(57) ABSTRACT

To reduce cost and size of a throttle valve control device, one end 3*a* of a throttle valve shaft 3 fixedly has a throttle valve lever 5 energized in valve opening direction by a throttle valve lever open spring 8, and rotatably has a drive gear 6 connected to a motor gear 9, a limp opening control lever 15 is fixed at another end 13*b* of a drum shaft 13 axially supported by a first cover 12, an accelerator drum 14 energized in valve closing direction by a drum close spring 16 is fixed at one end 12*a*, a first opening directional end face 5*a* of the throttle valve lever 5 is provided facing a limp opening control end face 15*b*, and a second opening directional end face 5*b* of the throttle valve lever 5 is provided facing a drive pin 6*a* of the drive gear 6.

3 Claims, 4 Drawing Sheets

THROTTLE VALVE CONTROL DEVICE

BACKGROUND OF THE INVENTION

1. Field of the Invention

The present invention relates to a throttle valve control device for controlling air amount supplied to an internal combustion engine of a two-wheeled vehicle, an outboard motor or the like. More particularly, the present invention relates to an improved throttle valve control device comprising a throttle valve shaft crossing an intake passage, being rotatably supported by a throttle body and being mounted with a throttle valve for opening/closing the intake passage;

a throttle valve lever being fixedly provided at the throttle valve shaft, being rotated synchronously with the throttle valve shaft and being energized in the opening direction of the throttle valve by a throttle valve lever open spring;

an accelerator drum being provided at one end of a drum shaft, being mechanically rotated and operated in the opening/closing directions of the throttle valve by an accelerator wire and being energized in the closing direction of the throttle valve by a drum close spring;

a limp opening control lever being provided another end of the drum shaft, facing the throttle valve lever and controlling an open position of the throttle valve lever opened by a throttle valve lever open spring to a limp opening position of the throttle valve in a full closure operation position of the accelerator drum; and a drive gear being rotated and controlled by a motor gear rotated synchronously with a motor, being rotatably supported by the throttle valve shaft and controlling a throttle valve open directional position and a throttle valve close directional position of the throttle valve lever and controlling opening/closing of the throttle valve corresponding to rotation of the motor; in which the drive gear is driven and controlled through the motor so that the opening position of the throttle valve correspond to the opening position of the accelerator drum.

2. Description of the Conventional Art

The above-described conventional throttle valve control device has been indicated in Japanese Patent Application Laid Open No. 2005-98178.

SUMMARY OF THE INVENTION

According to such the conventional throttle valve control device, a first throttle lever 10 is fixedly provided at a right end of a valve shaft 3*a*, and a second throttle lever 11 is fixedly provided at a left end of the valve shaft 3*a*.

Further, the first throttle lever 10 is given opening directional energizing force of a throttle valve 3 by a first open spring 12, and the second throttle lever 11 is given opening directional energizing force of the throttle valve 3 by a second open spring 13.

Further, a throttle sensor 52 is provided at a cover 51, and is fitted and connected with the left end of the valve shaft 3.

In this description, same codes as those in the above-referred gazette are used.

According to the above-described throttle valve control device, two throttle levers are prepared and fixedly provided at the throttle valve shaft. Thus, the number of parts is increased, and the number of assembling processes is increased, so that it is not preferable.

Further, one end of the first open spring is locked with the first throttle valve lever, and another end is locked with a throttle body. Further, one end of the second open spring is locked with the second throttle valve lever, and another end is locked with the throttle body. Thus, the number of assembling processes of these parts is remarkably increased, and the number of parts is also increased, so that it is not preferable. Further, since two springs comprising coil springs are prepared, the length of the spring in the free length direction is increased. Thus, the width of the throttle body is increased in size, so that it is not preferable.

Further, since the throttle sensor is provided at the cover, the fitting position of the throttle sensor to the throttle valve shaft may be varied by repetition of detaching and attaching of the cover at the time of the maintenance or the like, so that it is necessary to correct the position of the throttle sensor.

The present invention solves the above-described problems, and an objective of the present invention is to provide a throttle valve control device having low cost, in which the number of parts and assembling processes is decreased so as to decrease the production cost, and also to provide a throttle valve control device having excellent mountability on a two-wheeled vehicle having a limited housing space, in which the number of springs and throttle valve levers is decreased so as to reduce the width of a throttle body.

In order to solve the above-described problems, the throttle valve control device according to a first aspect of the present invention is structured such that one end of a throttle valve shaft which crosses an intake passage, is rotatably supported by a throttle body and is mounted with a throttle valve for opening/closing the intake passage, is provided projecting toward one side direction from one side wall of the throttle body;

one end of the throttle valve shaft fixedly has a throttle valve lever, which is given opening directional energizing force of the throttle valve by a throttle valve lever open spring, and rotatably has a drive gear including a drive pin facing the throttle valve lever, where the drive gear is geared and connected with a motor gear rotated synchronously by an output shaft of a motor M through an intermediate gear;

on the other hand, one end of a drum shaft rotatably supported by a first cover fixedly has an accelerator drum, which is given closing directional energizing force of the throttle valve by a drum close spring, and another end of the drum shaft fixedly has a limp opening control lever facing the throttle valve lever;

the limp opening control lever has a limp opening control end face facing a first opening directional end face of the throttle valve lever, where the first opening directional end face of the throttle valve lever is contacted with the limp opening control end face at the time of a full closing position of the limp opening control lever so as to control a limp opening of the throttle valve; and further, the drive pin provided at the drive gear is provided facing a second opening directional end face of the throttle valve lever, so as to rotate and control the throttle valve lever in the opening/closing directions of the throttle valve by the drive pin corresponding to rotation of the drive gear.

Further, according to a second aspect of the present invention, in addition to the above-described first aspect, the throttle valve lever, the drive gear including the drive pin, the limp opening control lever, and the intermediate gear including the motor gear are housed and provided in a first housing chamber formed by the one side wall of the throttle body and a first recessed part of a first cover.

Furthermore, according to a third aspect of the present invention, in addition to the above-described first aspect, a sensor housing hole is provided at another side wall of the throttle body facing another end of the throttle valve shaft, a throttle valve opening sensor is housed and provided in the sensor housing hole, and the another end of the throttle valve shaft is fitted and connected to the throttle valve opening sensor.

According to the first aspect of the present invention, the limp opening control lever is operated by a mechanical drive means by the accelerator drum, so as to control the limp opening of the throttle valve by the limp opening control end face of the limp opening control lever and the first opening directional end face of the throttle valve lever.

Further, the drive gear is operated by an electric drive means of the motor, so as to control an opening of the throttle valve at the time of an ordinary operation by the drive pin of the drive gear and the second opening directional end face of the throttle valve lever.

Accordingly, only the single throttle valve lever and the single throttle valve lever open spring are necessary to be prepared. Thus, the number of parts and assembling processes can be decreased, and the throttle valve control device having low cost can be provided.

Further, in the above-described device, only one coil spring is necessary to be prepared especially. Thus, the width of the throttle body can be reduced, so that mountability on a two-wheeled vehicle having a limited housing space can be improved.

Further, since the number of the throttle valve lever open spring is one, the relationship of spring force with the drum close spring can be correctly kept.

Further, according to the second aspect of the present invention, the first housing chamber is formed by the one side wall of the throttle body and the first recessed part of the first cover, and the throttle valve lever, the drive gear including the drive pin, the limp opening control lever, and the intermediate gear including the motor gear are provided in the first housing chamber. So, foreign matters are not caught between the limp opening control end face of the limp opening control lever and the first opening directional end face of the throttle valve lever, between the drive pin of the drive gear and the second opening directional end face of the throttle valve lever, and between teeth of gearing part including the drive gear, the intermediate gear and the motor gear. Thus, the throttle valve opening can be stably kept for a long period of time. Further, wear resistance at contacting points of these parts and in the gearing part can be improved. Especially, when the throttle valve control device is mounted on a two-wheeled vehicle, where the device is directly exposed to the external, it is preferable.

Further, according to the third aspect of the present invention, only a single throttle valve lever is necessary especially. Thus, the sensor housing chamber can be provided at another side wall of the throttle body, and the throttle valve opening sensor fitted and connected to another end of the throttle valve shaft can be provided in the sensor housing chamber. Accordingly, the throttle valve shaft and the throttle valve opening sensor can be supported by the common throttle body not through the other members, so that a rotation angle of the throttle valve shaft can be detected stably and correctly for a long period of time.

DETAILED DESCRIPTION OF PREFERRED EMBODIMENT

Hereinafter, one example of a throttle valve control device according to the present invention is described with FIG. 1.

Figure 1:
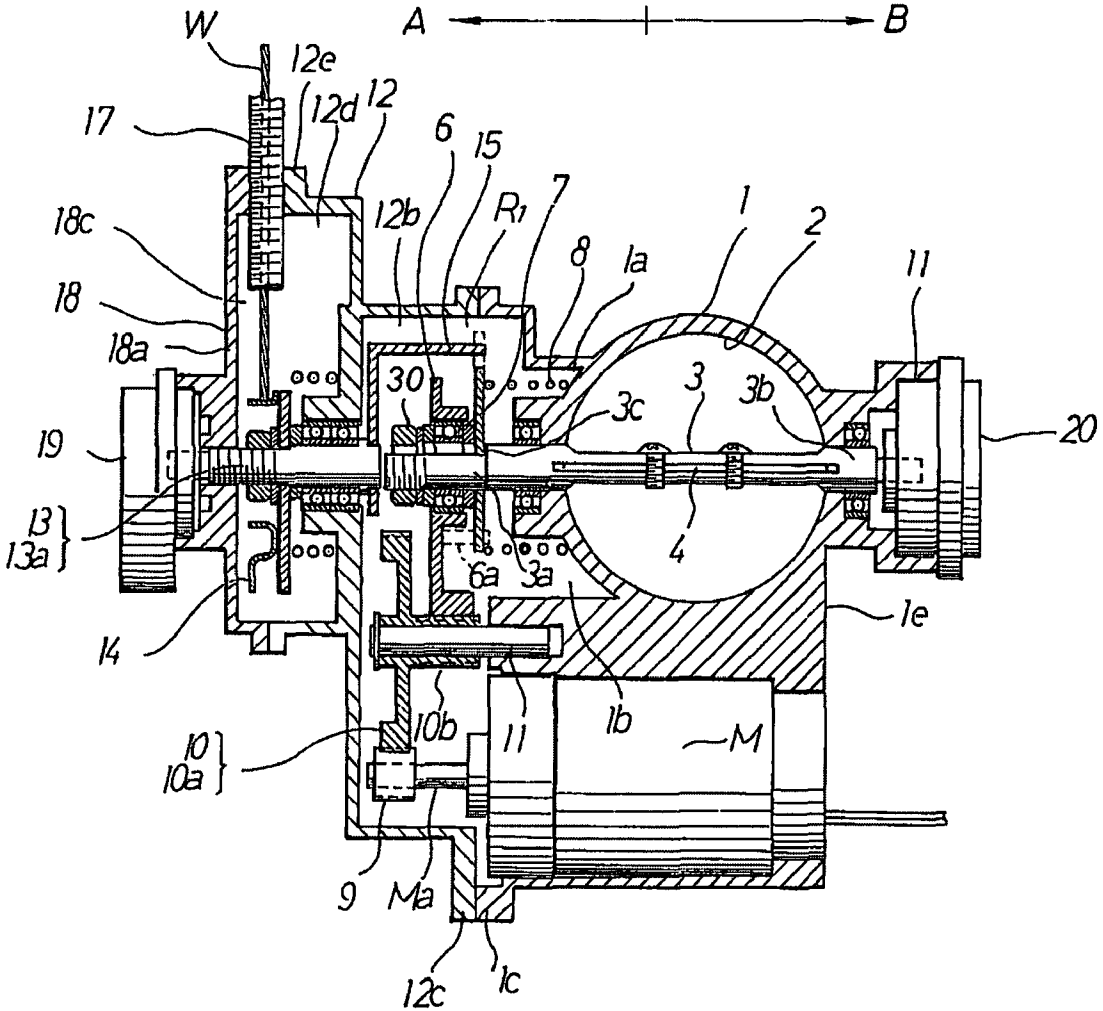
FIG. 1 is a longitudinal sectional view of main parts illustrating one example of a throttle valve control device according to the present invention.

FIG. 1 is a longitudinal sectional view of main parts.

A throttle body 1 has an intake passage 2 provided through therein. The upstream side of the intake passage 2 is connected to an air cleaner, and the down stream side is connected to an internal combustion engine.

A throttle valve shaft 3 crosses the intake passage 2, and both ends of the throttle valve shaft 3 are rotatably supported by the throttle body 1 through bearings. The throttle valve shaft 3 is screwed with a butterfly type throttle valve 4 for opening/closing the intake passage 2 by screws. That is, when the throttle valve shaft 3 is rotated, the throttle valve 4 synchronously controls opening/closing of the intake passage 2.

A throttle body recessed part 1*b* is recessed from one side wall 1*a* (a left side wall in the drawings) of the throttle body 1 toward one side direction A (the left direction in the drawings). A first flange part 1*c* is annularly formed at an opening end at one side of the throttle body recessed part 1*b*.

In addition, a motor housing hole 1*d* is provided at a lower part of the throttle body 1, and at least one end of the motor housing hole 1*d* is opened in the throttle body recessed part 1*b*. Further, a sensor housing hole 1*f* is provided at an another side wall 1*e* (a right side wall in the drawings) of the throttle body 1, and faces an another end part 3*b* of the throttle valve shaft 3.

An one end part 3*a* of the throttle valve shaft is provided being projected toward the one side direction A through the throttle body recessed part 1*b*, and assembled with the following parts from the one side wall 1*a* side of the throttle body 1 toward the one side direction A (the left direction in the drawings).

A throttle valve lever 5 is fixedly provided toward a locking stepped part 3*c* by a nut 30.

The throttle valve lever 5 is concretely described below.

A drive gear 6 is formed with a spur gear, and rotatably supported by the throttle valve shaft 3 through a bearing 7. The drive gear 6 is concretely described below. The throttle valve lever receives energizing force in the opening direction of the throttle valve 4 by a throttle valve open spring 8. The throttle valve open spring 8 made of a coil spring is inserted and provided from the one side direction A toward the one side wall 1*a* side of the throttle body 1, and one end of the throttle valve open spring 8 is locked with the throttle valve lever 5, and another end is locked with the throttle body 1.

Further, a motor M is inserted and provided in the motor housing hole 1*d*. A motor gear 9 is fixedly provided at an output shaft Ma projected toward the one side direction A from the motor M. The motor gear 9 and the drive gear 6 are geared and connected with an intermediate gear 10.

More particularly, the intermediate gear 10 is rotatably supported by a shaft 11 erected at the throttle body 1, and is formed in two stages with a large diameter gear 10*a* and a small diameter gear 10*b* which are formed in the axial direction. The large diameter gear 10*a* is geared with the motor gear 9, and the small diameter gear 10*b* is geared with the drive gear 6.

The throttle valve lever open spring 8, the throttle valve lever 5, the drive gear 6, the motor M, the motor gear 9 and the intermediate gear 10 faces to the throttle body recessed part 1*b* from the one side direction A, and are mounted toward the one side wall 1*a* of the throttle body 1 (that is, toward the another side direction B).

A first cover 12 has a first recessed part 12*b* recessed from a partition wall 12*a* toward the another side direction B. A second flange part 12*c* contacted with a first flange part 1*c* is formed at an opening end toward the another side direction B of the first recessed part 12*b*.

Further, a second recessed part 12*d* is recessed from the partition wall 12*a* toward the one side direction A, and a third flange part 12*e* is formed at an opening end toward the one side direction A of the second recessed part 12*d*.

Further, a bearing boss 12*f* is erected at the partition wall 12*a* of the first cover 12, and a drum shaft 13 is rotatably supported penetrating the bearing boss 12*f*. An one end 13*a* of the drum shaft 13 is provided being projected in the second recessed part 12*d*. Another end 13*b* of the drum shaft 13 is provided projecting in the first recessed part 12*b*.

Further, a accelerator drum 14 is fixed at the one end 13*a* of the drum shaft 13 projected in the second recessed part by a nut, and a limp opening control lever 15 is fixed at the another end 13*b* of the drum shaft 13 projected in the first recessed part 12*b*.

The limp opening control lever 15 is concretely described below.

A drum close spring 16 comprising a coil spring is provided on an outer periphery of the bearing boss and in the second recessed part 12*d*. One end of the drum close spring 16 is locked with the accelerator drum 14, and another end is locked with the first cover 12. Thereby, the drum shaft 13 is given energizing force in the closing direction of the throttle valve 4. Spring force of the drum close spring 16 is set stronger than that of the throttle valve lever open spring 8.

Further, a cable holder 17 has an accelerator wire W inserted and provided therein, and is fixedly provided between the first cover 12 and a second cover described below.

One end of the accelerator wire is locked with the accelerator drum 14 through a cylindrical cable end, and another end is locked with an accelerator grip operated by an operator. Accordingly, when an operator operates the accelerator grip, the accelerator drum 14 is rotated clockwisely or counterclockwisely by the accelerator wire W. The drum shaft 13 and the limp opening control lever 15 are rotated synchronously with rotation of the accelerator drum. A single cable holder 17 and a single accelerator wire W are illustrated in FIG. 1.

A second cover 18 has a third recessed part 18*c* recessed from a bottom part 18*a* toward a fourth flange part 18*b* at the another side direction B. A drum opening sensor 19 fitted and connected to the one end 13*a* of the drum shaft 13 is mounted on the bottom part 18*a*.

Further, a throttle valve opening sensor 20 is fixedly provided in the sensor housing hole 1*f* of the throttle body 1, and is fitted and connected to the another end part 3*b* of the throttle valve shaft 3.

Accordingly, the throttle valve lever 5, the drive gear 6, the intermediate gear 10, and the motor gear 9 are provided from the one side wall 1*a* of the throttle body 1 toward the one side direction A, where the throttle valve lever 5 has the throttle valve lever open spring 8 mounted on the one end 3*a* of the throttle valve shaft 3.

Further, the second flange part 12*c* of the first cover 12 is provided contacting with the first flange part 1*c* of the throttle body 1. So, the first housing chamber R1 is formed by the throttle body recessed part 1*b* and the first recessed part 12*b*. The throttle valve lever open spring 8, the throttle valve lever 5, the drive gear 6, the intermediate gear 10, the motor gear 9 and the limp opening control lever 15 are housed and provided in the first housing chamber R1.

Further, the fourth flange part 18*b* of the second cover 18 is provided contacting to the third flange part 12*e* of the first cover 12. So, the second housing chamber R2 is formed by the second recessed part 12*d* and the third recessed part 18*c*. The drum close spring 16, the accelerator drum 14 and the accelerator wire W are housed and provided in the second housing chamber R2.

The throttle valve control device controls opening/closing of the intake passage 2 by the following processes.

Figure 2:
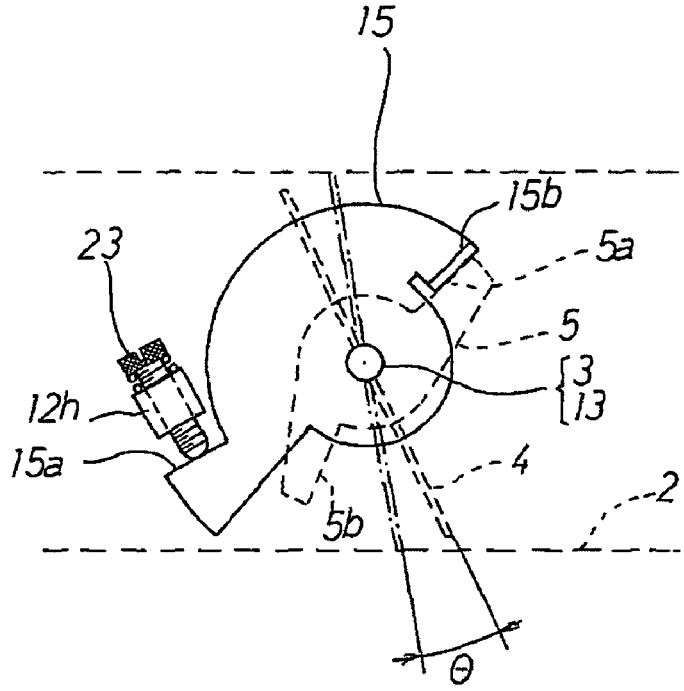
FIG. 2 is a schematic view illustrating a positional relationship between a limp opening control lever and a throttle valve lever 5 in the state that an internal combustion engine is stopped.
Figure 3:
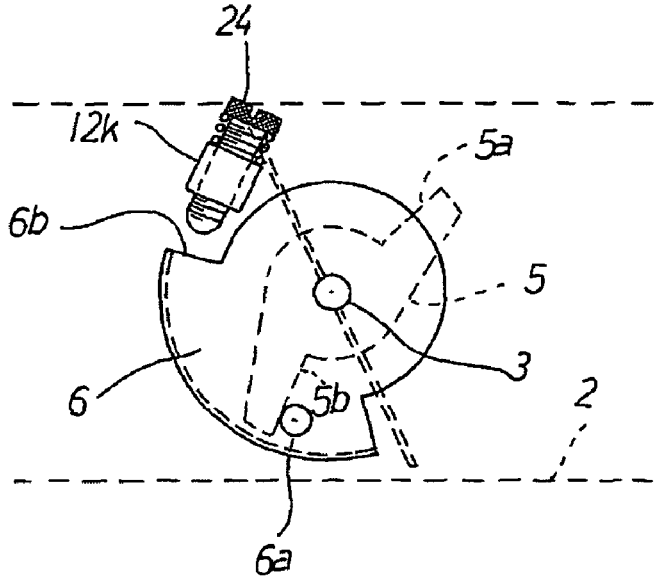
FIG. 3 is a schematic view illustrating a positional relationship between a drive gear and a throttle valve lever 5 in the state that an internal combustion engine is stopped.

The state of an internal combustion engine being stopped is described using FIGS. 2 and 3. The accelerator drum 14 is energized in the closing direction of the throttle valve 4 (in the clockwise direction in FIG. 2) by spring force of the drum close spring 16. The rotation position in the closing direction of the throttle valve 4 of the accelerator drum 14 is stopped at the closing position, at which a closing directional end face 15*a* of the limp opening control lever 15, which is synchronously rotated with the accelerator drum 14, is contacted with the top end of a limp adjusting screw 23, which is screwed to a first supporting boss 12*h* integrally formed with the first cover 12.

On the other hand, the throttle valve lever 5 is energized in the opening direction of the throttle valve 4 by spring force of the throttle valve lever open spring 8, that is, energized counterclockwisely in FIG. 2. The rotation of the throttle valve lever 5 in the throttle valve opening direction is stopped in the state that a first opening directional end face 5*a* of the throttle valve lever 5 is contacted with a limp opening control end face 15*b* of the limp opening control lever 15.

The limp opening control end face 15*b* is formed at the closing directional side of the throttle valve 4.

Further, in the state that the first opening directional end face 5*a* of the throttle valve lever 5 is contacted with the limp opening control end face 15*b* of the limp opening control lever 15, a limp opening θ of the throttle valve 4 (an opening being opened by θ angle from the fully closing state of the throttle valve 4), which is more opened than a first idling opening of the throttle valve 4, can be kept. Thereby, biting of the throttle valve 4 to the intake passage 2 at the time of stopping the internal combustion engine can be prevented, and the throttle valve 4 can be certainly opened to have the limp opening when the motor M cannot be operated. So, a limp running of a vehicle can be carried out.

On the other hand, in such the state, a drive pin 6*a* erected at the drive gear 6 is provided contacting to a second directional end face 5*b* of the throttle valve lever 5, as illustrated in FIG. 3. A space is formed between a closing directional end face 6*b* of the drive gear 6 and a top end of an idling adjusting screw 24, which is integrally formed with the first cover 12 and screwed to a second supporting boss 12*k*.

In addition, when the limb adjusting screw 23 is screwed so as to rotate the limb opening control lever 15, the throttle valve lever 5 can be rotated. Thereby, the limb opening θ of the throttle valve 4 can be properly and freely adjusted.

Figure 4:
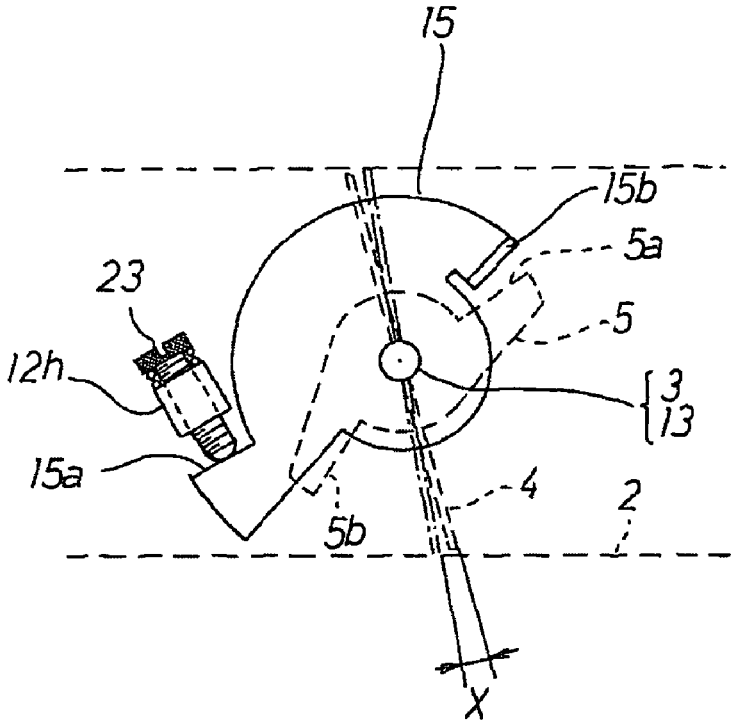
FIG. 4 is a schematic view illustrating a positional relationship between a limp opening control lever and a throttle valve lever in the state that an internal combustion engine is in idling-operation.
Figure 5:
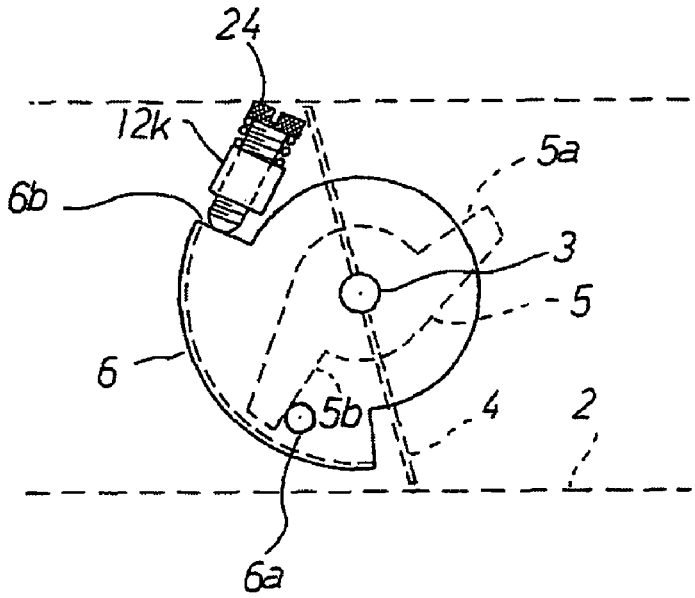
FIG. 5 is a schematic view illustrating a positional relationship between a drive gear and a throttle valve lever in the state that an internal combustion engine is in idling-operation.

Then, the idling operation of the internal combustion engine is carried out as illustrated in FIGS. 4 and 5.

That is, when the internal combustion engine starts and the drum opening sensor 19 determines the fully closing position of the accelerator drum 14, the motor M receives an output code from an electric control unit not illustrated in the drawings, and the drive gear 6 is clockwisely rotated in FIG. 5. Then, the drive pin 6*a* presses the second opening directional end face 5*b* of the throttle valve lever 5 so as to clockwisely rotate the throttle valve lever 5 while resisting against spring force of the throttle valve lever open spring 8, so that the throttle valve 4 is closed toward an desired idling opening X from the limb opening θ.

Further, when the desired idling opening X is confirmed by an output signal of the throttle valve opening sensor 20, operation of the motor M is stopped, and thereby, the desired idling opening of the throttle valve 4 can be kept.

In addition, since the idling adjusting screw 24 is screwed, a rotation position in the clockwise direction of the drive gear 6 can be controlled, and the idling opening X can be properly and freely adjusted.

Further, in the above-described idling operation, an operator does not operate opening the accelerator drum 14, and the closing directional end face 15*a* of the limb opening control lever 15 is provided contacting with the limb adjusting screw 23 yet. Thus, the first opening end face 5*a* of the throttle valve lever 5 is positioned separating from the limb opening control end face 15*b* of the limb opening control lever 15.

Figure 6:
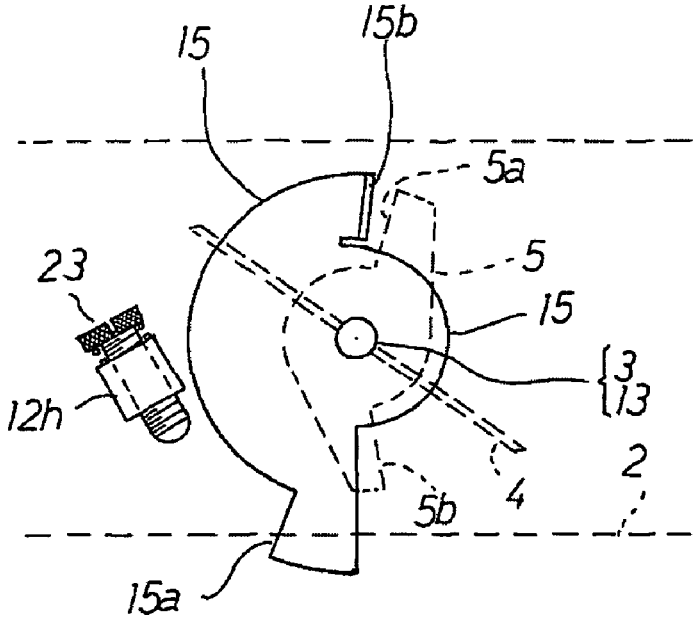
FIG. 6 is a schematic view illustrating a positional relationship between a limp opening control lever and a throttle valve lever in the state that an internal combustion engine is operated with a middle opening.

Further, in an accelerative operation of the internal combustion engine, the accelerator drum 14 is counterclockwisely rotated in FIG. 6 by the accelerator wire W. The electric control unit operates the motor M on the basis of an output signal of the drum opening sensor 19 for detecting the rotation angle of the accelerator drum 14, so as to counterclockwisely rotate the drive gear 6 in FIG. 6, so that the drive pin 6*b* is also synchronously moved in the opening direction (in the counterclockwise direction).

Accordingly, the second opening directional end face 5*b* of the throttle valve lever 5 is counterclockwisely rotated following the movement of drive pin 6*a* by spring force of the throttle valve lever open spring 8, so that the throttle valve 4 opens the intake passage 2.

Further, when the electric unit confirms that the output signal of the throttle valve opening sensor 20 for detecting the opening of the throttle valve 4 is matched with the output signal of the drum opening sensor 19 for detecting the opening of the accelerator drum 14, the electric control unit stops the operation of the motor M, and thereby, the throttle valve 4 can have the opening corresponding to the opening position of the accelerator drum 14.

Figure 7:
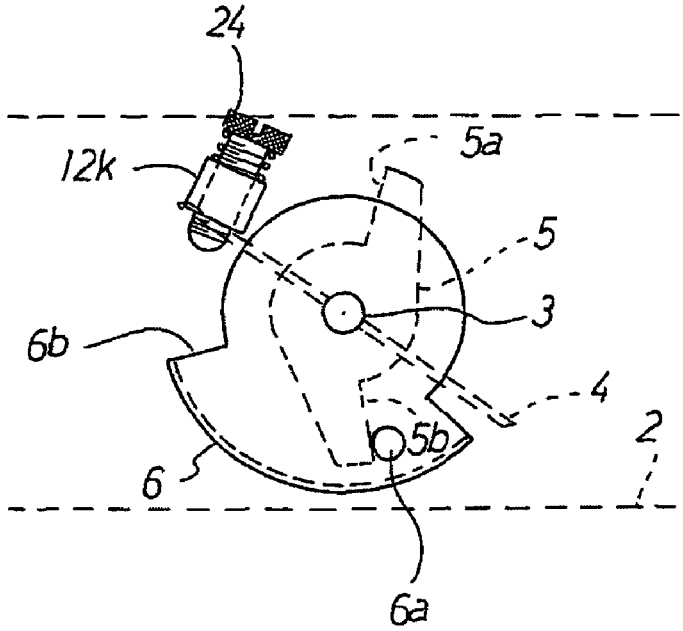
FIG. 7 is a schematic view illustrating a positional relationship between a drive gear and a throttle valve lever in the state that an internal combustion engine is operated with a middle opening.

These operations are illustrated in FIG. 6 and FIG. 7.

On the other hand, in a speed reducing operation of the internal combustion engine, the accelerator drum 14 is clockwisely rotated in FIG. 6 by the accelerator wire W, and electric control unit operates the motor M on the basis of the output signal of the drum opening sensor 19 for detecting the rotation angle of the accelerator drum 14. Thus, the drive gear 6 is clockwisely rotated in FIG. 6, and the drive pin 6*a* is also synchronously moved in the closing direction (the clockwise direction).

Accordingly, the drive pin 6*a* clockwisely presses and rotates the second opening directional end face 5*b* of the throttle valve lever 5 so as to clockwisely rotate the throttle valve lever 5 corresponding to the movement of the drive pin 6*a*, so that the throttle valve 4 closes the intake passage 2.

Further, rotation of the motor M is stopped at a position where the output signals of the drum opening sensor 19 and the throttle valve opening sensor 20 are matched, and the throttle valve 4 can keep the opening corresponding to the closing directional position of the accelerator drum 14.

According to the throttle valve control device of the present invention, the throttle valve lever facing the drive pin 6*a* of the drive gear 6 and the throttle valve lever facing the limp opening control end face 15*b* of the limp opening control lever 15 are made into the common single throttle valve lever 5. Further, the throttle valve open spring 8 for giving opening directional energizing force to the throttle valve lever is made into the single spring. Thereby, the number of parts can be decreased, and the number of assembling processes of the throttle valve lever 5 and the throttle valve open spring 8 can be decreased, so that the production cost can be reduced.

Further, in the above-described device, each of the throttle valve lever 5 and the throttle valve open spring 8 is a single. Thereby, the width of the throttle body can be reduced, so that the throttle valve control device reduced in size can be obtained. So, mountability on a two-wheeled vehicle having a limited housing space can be improved especially.

Further, the drum close spring 16 is set to have stronger spring force than that of the throttle valve lever open spring 8. However, since the difference is between these single springs, the difference between the above-described spring forces can be set correctly and easily.

Further, the first housing chamber R1 is formed by the one side wall 1*a* of the throttle body 1 and the first recessed part 12*b* of the first cover 12 facing the one side wall 1*a*. The throttle valve lever 5, the drive gear 6 including the drive pin 6*a*, the limp opening control lever 15, and the intermediate gear 10 including the motor gear 9 are provided in the first housing chamber R1. So, foreign matters are not caught between the first opening directional end face 5*a* of the throttle valve lever 5 and the limp opening control end face 15*b*, between the second opening directional end face 5*b* and the drive pin 6*a*, and between teeth of the gearing parts including the drive gear 6, the intermediate gear 10 and the motor gear 9. Therefore, the stable throttle valve opening control can be kept for a long period of time. Further, wear resistance at the contacting points of these parts and in the gearing parts can be increased. Especially, when the throttle valve control device is mounted on a two-wheeled vehicle where the device is directly exposed to an external, it is preferable.

Furthermore, since the throttle valve lever 5 is a single, the another end 3*b* of the throttle valve shaft 3 is opened. Thereby, the sensor housing hole 1*f* can be provided at the another side wall 1*e* of the throttle body 1 facing the another end 3*b* of the throttle valve shaft 3, and the throttle valve opening sensor 20 housed in the sensor housing hole 1*f* can be fitted and connected to the another end 3*b* of the throttle valve shaft 3.

Accordingly, since the throttle valve shaft 3 and the throttle valve opening sensor 20 are supported by the throttle body 1, which is the common member for those, so that the rotation angle of the throttle valve shaft 3 can be detected correctly and stably for a long period of time.

What is claimed is:

1. A throttle valve control device wherein one end of a throttle valve shaft, which crosses an intake passage, is rotatably supported by a throttle body and is mounted with a throttle valve for opening/closing the intake passage, is provided projecting toward one side direction from an one side wall of the throttle body;

the one end of the throttle valve shaft fixedly has a throttle valve lever, which is given opening directional energizing force of the throttle valve by a throttle valve lever open spring, and rotatably has a drive gear including a drive pin facing the throttle valve lever;

the drive gear is geared and connected with a motor gear rotated synchronously with an output shaft of a motor, through an intermediate gear;

one end of a drum shaft rotatably supported by a first cover fixedly has an accelerator drum, which is given closing directional energizing force of the throttle valve by a drum close spring, and another end of the drum shaft fixedly has a limp opening control lever facing the throttle valve lever;

the limp opening control lever has a limp opening control end face facing a first opening directional end face of the throttle valve lever;

the first opening directional end face of the throttle valve lever is contacted with the limp opening control end face at the time of a full closing position of the limp opening control lever so as to control a limp opening of the throttle valve; and the drive pin provided at the drive gear is provided facing a second opening directional end face of the throttle valve lever, and rotates and controls the throttle valve lever in the opening/closing directions of the throttle valve by the drive pin corresponding to rotation of the drive gear.

2. The throttle valve control device as claimed in claim 1, wherein the throttle valve lever, the drive gear including the drive pin, the limp opening control lever, and the intermediate gear including the motor gear are housed and provided in a first housing chamber formed by the one side wall of the throttle body and a first recessed part of a first cover.

3. The throttle valve control device as claimed in claim 1, wherein a sensor housing hole is provided at an another side wall of the throttle body facing another end of the throttle valve shaft, a throttle valve opening sensor is housed and provided in the sensor housing hole, and the another end of the throttle valve shaft is fitted and connected to the throttle valve opening sensor.

* * * * *